US009358797B2

(12) United States Patent
Saikawa

(10) Patent No.: US 9,358,797 B2
(45) Date of Patent: Jun. 7, 2016

(54) LIQUID TANK AND LIQUID EJECTING APPARATUS

(71) Applicant: CANON KABUSHIKI KAISHA, Tokyo (JP)

(72) Inventor: Hideo Saikawa, Machida (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/830,434

(22) Filed: Aug. 19, 2015

(65) Prior Publication Data

US 2016/0059573 A1 Mar. 3, 2016

(30) Foreign Application Priority Data

Aug. 26, 2014 (JP) ..... 2014-171700

(51) Int. Cl.
*B41J 29/38* (2006.01)
*B41J 2/175* (2006.01)

(52) U.S. Cl.
CPC ..... *B41J 2/17526* (2013.01); *B41J 2/1752* (2013.01); *B41J 2/17523* (2013.01)

(58) Field of Classification Search
None
See application file for complete search history.

(56) References Cited

U.S. PATENT DOCUMENTS

| | | | | |
|---|---|---|---|---|
| 7,213,914 | B2 | 5/2007 | Anma et al. | 347/86 |
| 7,841,711 | B2 | 11/2010 | Matsumoto et al. | 347/86 |
| 8,382,265 | B2 | 2/2013 | Matsumoto et al. | 347/86 |
| 8,454,141 | B2 | 6/2013 | Matsumoto et al. | 347/86 |
| 8,529,034 | B2 | 9/2013 | Matsumoto et al. | 347/86 |
| 8,596,770 | B2 | 12/2013 | Matsumoto et al. | 347/86 |
| 8,678,569 | B2 | 3/2014 | Matsumoto et al. | 347/86 |
| 8,678,570 | B2 | 3/2014 | Matsumoto et al. | 347/86 |
| 8,801,162 | B2 | 8/2014 | Matsumoto et al. | 347/86 |
| 2005/0219303 | A1 | 10/2005 | Matsumoto et al. | 347/19 |
| 2008/0204529 | A1 | 8/2008 | Matsumoto et al. | 347/86 |
| 2009/0128609 | A1 | 5/2009 | Matsumoto et al. | 347/86 |
| 2010/0208015 | A1 | 8/2010 | Matsumoto et al. | 347/86 |
| 2010/0302291 | A1 | 12/2010 | Matsumoto et al. | 347/6 |
| 2010/0309265 | A1 | 12/2010 | Matsumoto et al. | 347/86 |
| 2010/0309266 | A1 | 12/2010 | Matsumoto et al. | 347/86 |
| 2012/0055397 | A1* | 3/2012 | Kodama | B41J 2/17523 118/300 |
| 2013/0208044 | A1 | 8/2013 | Matsumoto et al. | 347/19 |
| 2014/0320557 | A1 | 10/2014 | Matsumoto et al. | 347/5 |

FOREIGN PATENT DOCUMENTS

JP 2011-93328 5/2011

OTHER PUBLICATIONS

U.S. Appl. No. 14/830,439, filed Aug. 19, 2015; Inventor: Hideo Saikawa.

* cited by examiner

*Primary Examiner* — Lisa M Solomon
(74) *Attorney, Agent, or Firm* — Fitzpatrick, Cella, Harper & Scinto

(57) ABSTRACT

A liquid ejecting apparatus informs a user when an ink tank is substantially mechanically attached so as to prevent an attaching operation from being stopped by a user before completion of attachment of the ink tank. A board is provided with a light emitter, and a control unit for controlling the light emitter according to a conductive state between an electrode and a counterpart electrode. The liquid tank is moved by force P, a second engaging portion is locked to a second locking portion, and then, the liquid tank is attached to a holder at an attachment completion position. The non-conductive state between the electrodes is changed to a conductive state before the second engaging portion engages with the second locking portion, and then, the liquid tank is fixed at the attachment completion position during movement in a reverse direction after the liquid tank passes the attachment completion position.

11 Claims, 10 Drawing Sheets

LIQUID TANK AND LIQUID EJECTING APPARATUS

BACKGROUND OF THE INVENTION

1. Field of the Invention

The present invention relates to a liquid tank and a liquid ejecting apparatus. More particularly, the present invention relates to a liquid tank containing liquid therein and a liquid ejecting apparatus having the liquid tank detachably attached thereto, wherein the attached state of the liquid tank is detected in the liquid ejecting apparatus for ejecting liquid supplied from the liquid tank.

2. Description of the Related Art

A liquid ejecting apparatus is exemplified by an ink jet printing apparatus. An ink tank containing ink therein is replaced with a new one by a user so that ink can be replenished to the ink jet printing apparatus. The ink tank serving as a liquid tank is generally configured to be detachably attached to a holder disposed in the ink jet printing apparatus or a holder disposed at a carriage of the ink jet printing apparatus.

In the ink jet printing apparatus having the above-described configuration, in a case where a user improperly attaches the ink tank at a predetermined position of the holder during the replacement of the ink tank, the ink cannot be supplied to a print head. In view of this, there is provided an ink jet printing apparatus configured to inform a user of the completion of attachment at a timing at which the ink tank is properly attached such that the user can confirm the completion of the attachment.

Japanese Patent Laid-Open No. 2011-93328 discloses providing information whether or not the attachment state of an ink tank is properly completed for a user or an ink jet printing apparatus by using the emission or non-emission of light or the state of light emission (blinking or the like). In FIGS. 5 and 7 of Japanese Patent Laid-Open No. 2011-93328, as a user depresses an ink tank (1) in a direction indicated by an arrow P, a second engaging portion (6) engages with a second locking portion (156) to be thus mechanically set, so that the ink tank can be attached. Upon completion of the attaching operation, an electrode (102) on the side of the ink tank is brought into conduction to an electrode (152) on the side of a carriage of the ink jet printing apparatus, thereby detecting that the ink tank is attached. Upon the detection, a first light emitter (101) is controlled to emit light.

With the above-described configuration, it is possible to visually determine whether or not the ink tank can be properly attached, and therefore, a determination can be more certainly made in comparison with functional determination depending upon the feeling of a hand or a finger.

SUMMARY OF THE INVENTION

The present invention provides a liquid tank installed in a liquid ejecting apparatus and provided with a structure to be attached to an attaching unit including an introducing portion and a locking portion and a first electrode, the structure including a supplying portion that can be joined to the introducing portion and an engaging portion engageable with the locking portion, wherein the supplying portion is joined to the introducing portion at an attachment completion position at which the engaging portion engages with the locking portion, so as to supply a contained liquid from the supplying portion to the liquid ejecting apparatus. The liquid tank includes: an informing unit; and a control unit configured to control the informing unit according to a conductive state between a second electrode corresponding to the first electrode at the attaching unit and the first electrode. The liquid tank is moved with respect to the attaching unit by force acting at a predetermined portion in a predetermined direction so that the engaging portion engages with the locking portion, and thus, the liquid tank is attached to the attaching unit at the attachment completion position. Furthermore, the liquid tank is configured such that the conductive state between the first electrode and the second electrode is changed to the non-conductive state before the liquid tank is fixed at the attachment completion position in engagement of the engaging portion with the locking portion during movement reverse to the predetermined direction after the liquid tank passes the attachment completion position during the movement in the predetermined direction.

As used herein, the electrodes are also referred to as tank-side electrodes or apparatus-side electrodes, as appropriate.

Further features of the present invention will become apparent from the following description of exemplary embodiments (with reference to the attached drawings).

DESCRIPTION OF THE EMBODIMENTS

Figure 1:
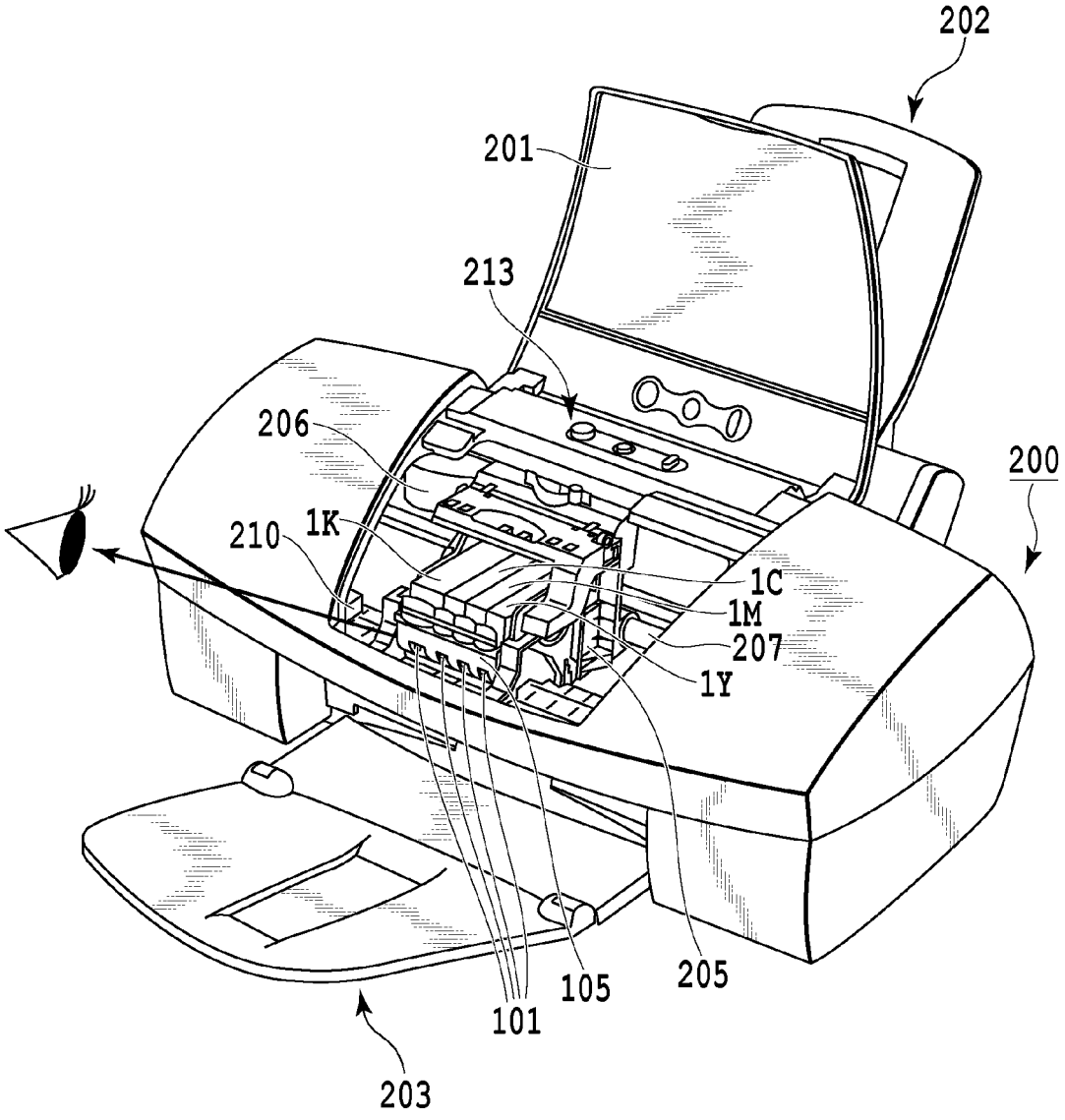
FIG. 1 is a perspective view showing an ink jet printing apparatus in a first embodiment of the present invention.

In Japanese Patent Laid-Open No. 2011-93328, it is desirable that both of the electrodes should be brought into conduction to each other at the same time when the second engaging portion (6) of the ink tank engages with the second locking portion (156). However, an actual product has dimensional variations of constituent parts, and therefore, it is difficult to make the timings of engagement and conduction match each other. In a case where the engagement first happens, the electrodes are not brought into conduction to each other in a case where the ink tank (1) is set at the holder (105), and therefore, information on the ink tank (1) cannot be transmitted to the ink jet printing apparatus. In view of this, it is necessary to complete the conduction earlier than the engagement to some extent. In a normal case, the electrodes (102) and (152) are brought into conduction to each other slightly earlier than the engagement of the second engaging portion (6) with the second locking portion (156), and then, light emission indicating the attachment of the ink tank (1) is achieved upon the conduction.

Here, assuming that a user who relatively slowly depresses the ink tank performs the attaching operation, he or she possibly stops the attaching operation immediately after the light emission according to the conduction is confirmed and before the second engaging portion (6) engages with the second locking portion (156). In this case, the ink tank attachment remains uncompleted, and therefore, the ink is insufficiently supplied from the ink tank (1), thereby failing to achieve proper printing.

First Embodiment

Explanation of Ink Jet Printing Apparatus

FIG. 1 is a perspective view showing the outer appearance of an ink jet printing apparatus 200 in a first embodiment of the present invention in a state in which a body cover 201 is opened.

As shown in FIG. 1, in the ink jet printing apparatus 200 serving as a liquid ejecting apparatus in the present embodiment, a carriage 205 having an ink jet print head and an ink tank (i.e., a liquid tank) mounted thereon reciprocates to perform printing. In addition to an ink jet printing apparatus body serving as an essential part for performing printing, a sheet discharge tray 203 and an automatic sheet feeder (abbreviated as "ASF") 202 are disposed in front of and at the back of the apparatus body, respectively.

In a case where a user opens the body cover 201, the carriage 205 is automatically moved to substantially the center position shown in FIG. 1 (hereinafter also referred to as a "tank replacement position"). The user replaces an ink tank 1K, 1Y, 1M, or 1C (hereinafter these ink tanks may be designated by the same reference numeral "1") at the tank replacement position.

The ink jet printing apparatus in the present embodiment includes ink jet print heads 105 provided with ejecting portions, not shown. The ejecting portions are adapted to eject ink to a print medium such as a sheet according to the reciprocating motion of the carriage 205, thereby performing printing. The ink jet print heads corresponding to the K, Y, M, and C color inks eject the inks based on ejection data. The ink jet print heads perform scanning according to the above-described movement, eject the inks to the print medium, and thus, perform printing.

In the carriage 205 are disposed the substantially rectangular parallelepiped ink tanks 1 and the ink jet print head 105 integrated with a holder 150 for holding the ink tanks therein. In the meantime, all of the ink tanks 1 are detachably attached to the ink jet print head 105.

(Explanation of Ink Jet Print Head)

Figure 2:
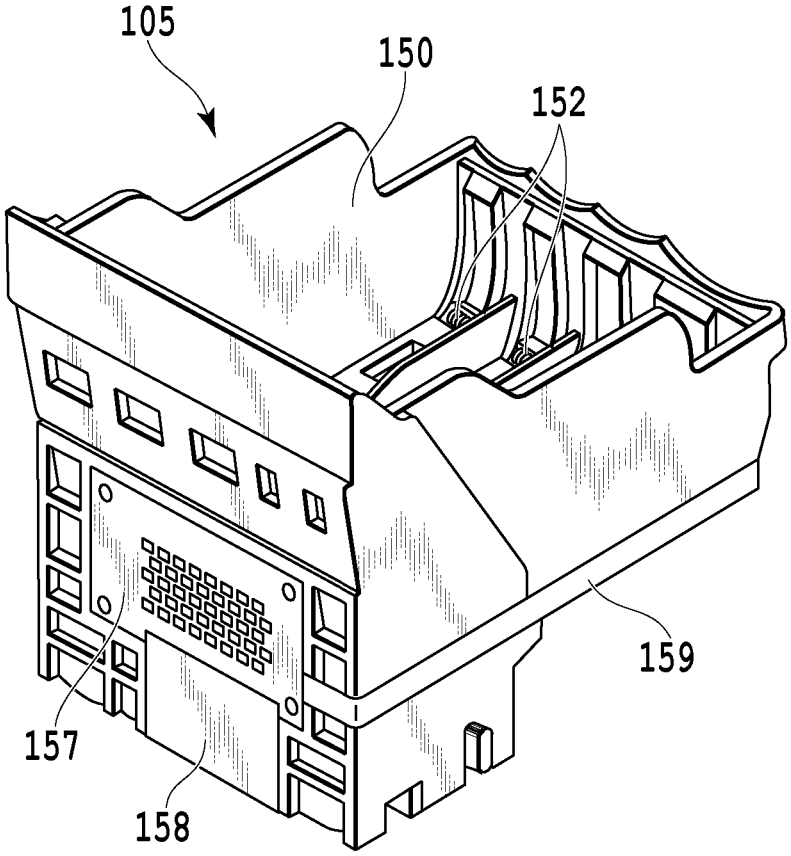
FIG. 2 is a perspective view showing an ink jet print head, in which an ink tank according to the present embodiment to be mounted on the ink jet printing apparatus shown in FIG. 1 is configured to be detachably attached.

FIG. 2 is a perspective view showing one example of the ink jet print head, in which the ink tank according to the present embodiment is configured to be detachably attached. The ink jet print head 105 generally includes the holder 150 for detachably holding the plurality of ink tanks and ejecting portions, not shown, arranged at a bottom. The ink tank containing the ink therein is attached to the holder 150, so that an ink inlet port (i.e., a liquid inlet portion) on the side of the ink jet print head at the bottom of the holder and an ink supply port (i.e., a liquid supplying portion) on the side of the ink tank are coupled to each other, thus forming an ink communication channel therebetween.

The ejecting portion includes a heat generation resistant element inside of a liquid channel constituting a nozzle, applies a pulse signal to the resistant element so as to apply thermal energy to the ink, and then, ejects the ink by bubbling energy generated in the ink at this time. After that, a signal transmitting electric contact, not shown, disposed at the carriage 205 and an electric contact 157 on the side of the ink jet print head 105 are brought into contact with each other, thus transmitting a print signal to a heat generation resistant element drive circuit at the ejecting portion via a wire 158.

In the ink jet print head 105 provided with tank holder portions storing the ink tanks 1 therein, respectively, connectors 152 are disposed in a manner corresponding to the ink tanks, respectively. Each of the connectors 152 is brought into contact with a pad on the board disposed in a manner facing the ink tank 1 to be disposed, and thus, it is brought into conduction to each other. Moreover, a wire 159 extends from the electric contact 157 to each of the connectors 152.

Figure 3A:
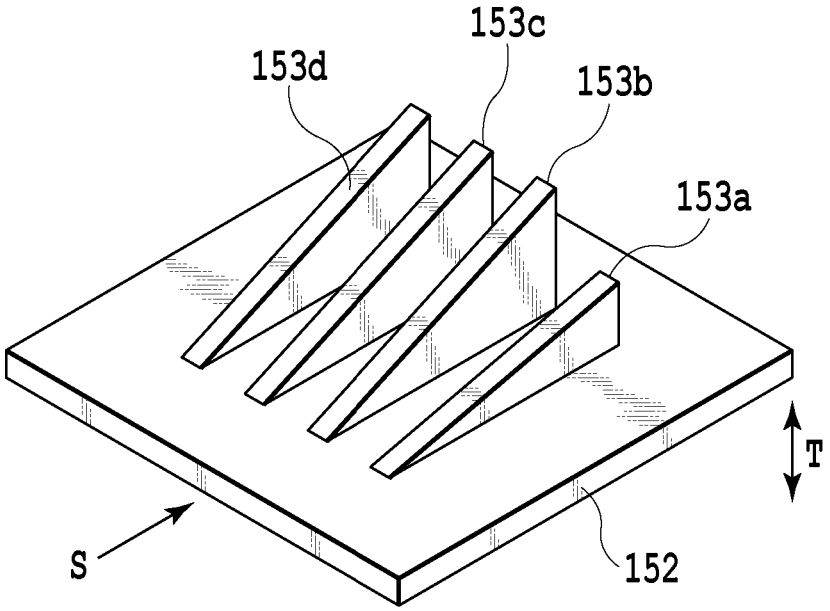
FIG. 3A and FIG. 3B are views showing the configuration of essential parts of a holder provided for the ink jet print head shown in FIG. 2.
Figure 3B:
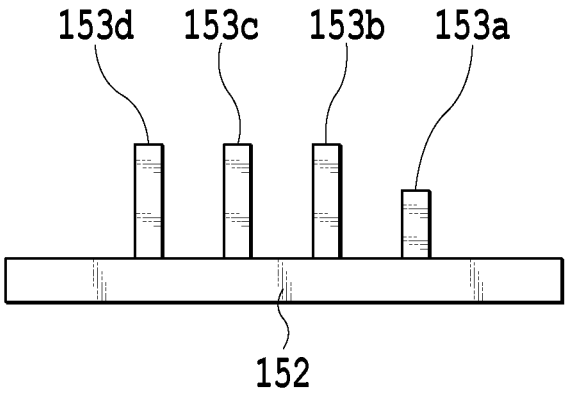

Here, FIG. 3A is an enlarged perspective view showing the connector 152; and FIG. 3B is a schematic view showing the connector 152 shown in FIG. 3A, as viewed in a direction indicated by an arrow S.

Pins 153*a* to 153*d* are made of a conductive material. In a case where the pins 153*a* to 153*d* are depressed at the tips thereof, they are reversibly deformed in a direction indicated by a double-headed arrow T whereas in a case where the pressing force is released, they are restored to their original shapes. The pin 153*a* is designed to play a role in detecting the attached state of the ink tank 1 to the holder 150: in contrast, the pins 153*b* to 153*d* are adapted to play a role in transmitting information on the residual amount of the ink in the ink tank 1 or supplying electric power. Here, the pins 153*b* to 153*d* are longer that the pin 153*a*.

(Explanation of Tank)

Figure 4A:
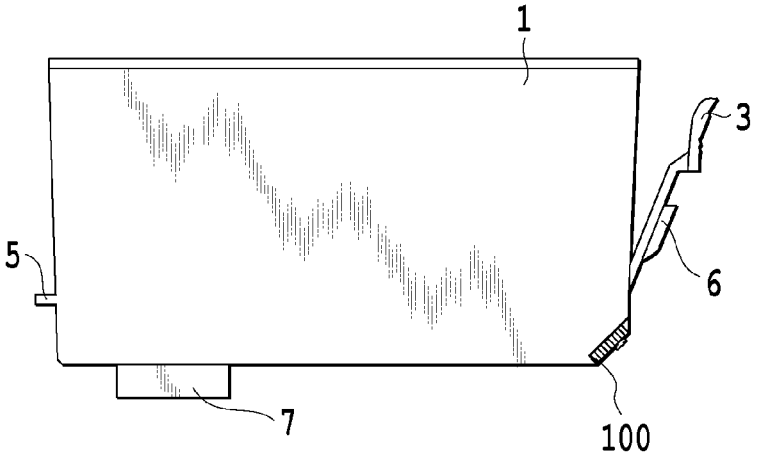
FIG. 4A is a side view showing the ink tank to be mounted on the ink jet printing apparatus shown in FIG. 1.
Figure 4B:
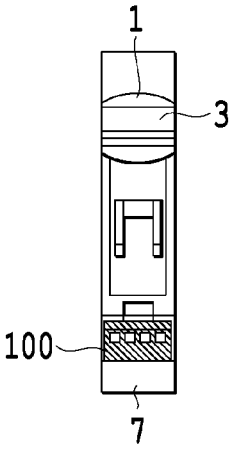
FIG. 4B is a front view showing the ink tank to be mounted on the ink jet printing apparatus shown in FIG. 1.
Figure 4C:
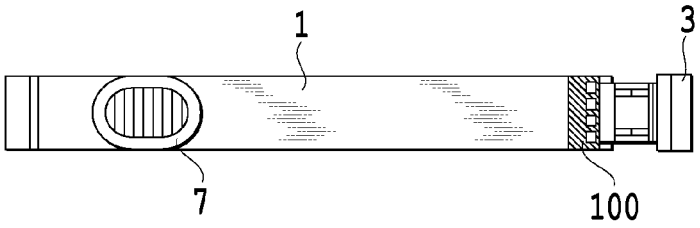
FIG. 4C is a plan view showing the ink tank to be mounted on the ink jet printing apparatus shown in FIG. 1.

FIGS. 4A, 4B, and 4C are a side view, a front view, and a bottom view of the ink tank according to the present embodiment, respectively. In the present description, the front of the ink tank signifies a plane on which a user can see the attaching operation of the ink tank and light emission of a light emitting element such as an LED, described later.

The ink tank 1 in the present embodiment has a support member 3 supported at the lower portion on the front side. The support member 3 is made of a resin and formed into a rod-like shape in a manner integral with the exterior of the ink tank 1, and further, is configured to be displaceable on a portion to be supported at the time of the attaching operation to the holder, described later. A first engaging portion 5 and a second engaging portion 6 (that is integrated with the support member 3 in the present embodiment) that can engage with locking portions disposed on the side of the holder are disposed on the back side of the ink tank 1 and the front side opposite to the back side, respectively. The engagement of the first engaging portion 5 and the second engaging portion 6 secures the attached state of the ink tank 1 to the holder. Operation at the time of the attachment will be described later with reference to FIGS. 6A to 6F.

At the bottom of the ink tank 1 is formed an ink supply port 7, through which the ink is supplied in connection to the ink inlet port formed at the ink jet print head 105 when the ink tank 1 is attached to the holder. A board 100 is disposed at a portion at which the bottom and the front intersect and at the bottom of a support portion of the support member 3.

Figure 5A:
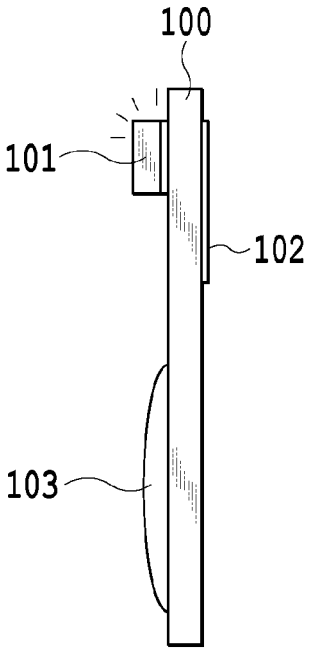
FIG. 5A is a front view showing a board provided for the ink tank shown in FIGS. 4A to 4C.
Figure 5B:
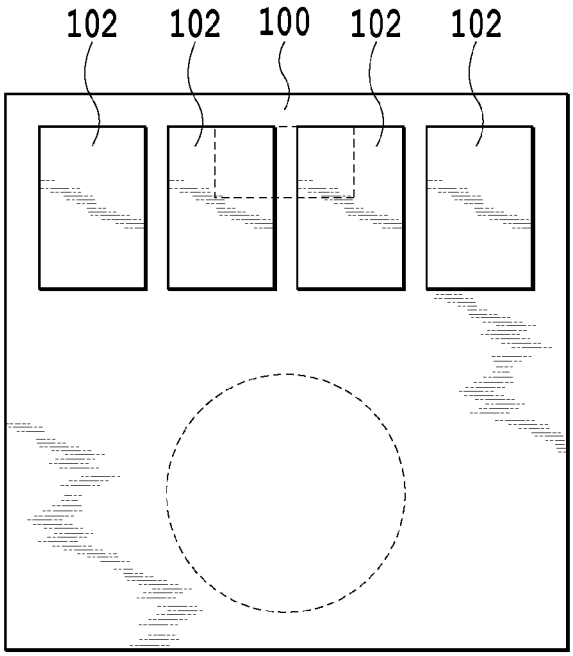
FIG. 5B is a side view showing the board provided for the ink tank shown in FIGS. 4A to 4C.

Here, FIGS. 5A and 5B show the board 100 that is detached from the ink tank 1. FIG. 5A is a view showing the board 100, as viewed sideways; and FIG. 5B is a view showing the board 100, as viewed on the side of the holder. On the board 100 positioned inward of the ink tank 1 are disposed a light emitter 101 such as an LED for generating visible light and a control unit 103.

The control unit 103 detects that the ink tank 1 is properly mounted at the tank replacement position that has been explained with reference to FIG. 1 according to the conduction of a pad 102 facing the pin 153*a* in a case where a user mounts the ink tank in a manner, described later, and thus, allows the light emitter 101 to emit light.

The control unit 103 further controls to transmit various pieces of information on the ink tank 1 toward a main body via the other pins conducted to the other pads 102 and a flexible cable 206 (FIG. 1). These pieces of information include the properness of the type of ink tank disposed, the residual amount of the ink, and the like. A control circuit disposed on the main body side that receives these pieces of information controls to display them on a display, as required.

Aside from the above, the control circuit on the main body side may transmit a control signal to the control unit 103 via the pin 153*a* and the pad 102 in a case where the pin 153*a* is conducted to the pad 102, so that the control unit 103 controls to allow the light emitter 101 to emit light.

(Explanation of Ink Tank Attaching Procedures)

FIGS. 6A to 6C and 6E show a series of movements in which the ink tank 1 is attached to the holder 150 of the ink jet print head 105. FIGS. 6D and 6F respectively show enlarge essential parts shown in FIGS. 6C and 6E, and show the engagement state and the conduction state between the pad 102 and the pin 153*a*. Table 1 below shows the corresponding interrelationships of the engagement state, the conduction state, and the light emission of the LED in FIGS. 6B, 6C, and 6E.

TABLE 1

Figures 6A, 6B, 6C, 6D, 6E, 6F:
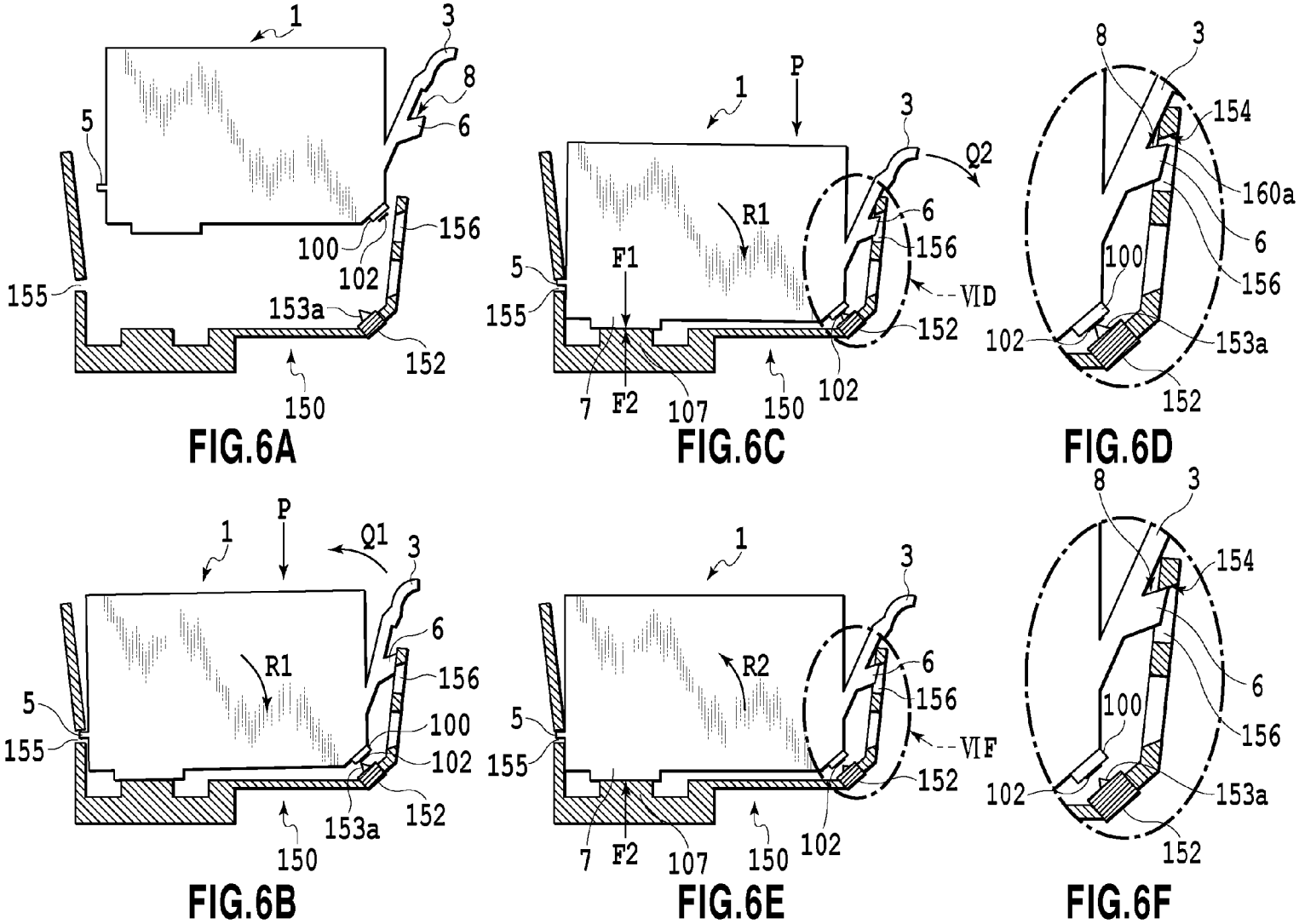
FIGS. 6A to 6F are cross-sectional views schematically illustrating attaching procedures in a case where the ink tank according to the first embodiment is attached to the holder shown in FIG. 2.

| | | Electrically conducted state | | |
|---|---|---|---|---|
| FIG. No. | Engagement state of ink tank with holder | Pin 153a (for detecting attachment) | Pins 153b, 153c, 153d (for transmitting information) | Light emission from LED |
| FIG. 6B | Not-engaged | Not-conducted | Conducted | Not-emitted |
| FIG. 6C | | Conducted | | |
| FIG. 6E | Engaged (completion of attachment) | Not-conducted | | Emitted |

In a case where the ink tank 1 is attached to the holder 150 of the ink jet print head 105, the ink tank 1 is disposed above the holder 150, as shown in FIG. 6A. Subsequently, the states shown in Table 1 will be explained with reference to FIGS. 6A to 6F, 7, and 8.

Next, as shown in FIG. 6B, the ink tank 1 is placed at the bottom of the holder in the state in which the first engaging portion 5 formed into a projection-like shape on the back side of the ink tank 1 is locked to a first locking portion 155 formed into a through hole-like shape on the back side of the holder 150. In this state, an upper portion on the front side of the ink tank 1 is depressed in a direction indicated by an arrow P, so that the ink tank 1 is turned in a turning direction indicated by an arrow $R_1$ on the engagement portion between the first engaging portion 5 and the first locking portion 155 as a fulcrum, to be thus displaced downward in FIG. 6B. During this procedure, while the side surface of the second engaging portion 6 formed into a projection-like shape at the support member 3 of the ink tank 1 is pressed in abutment against the upper portion of a second locking portion 156 formed on the front side of the holder, the support member 3 is deformed in a direction indicated by an arrow $Q_1$ to approach the front surface of the ink tank 1. In this state, the pad 102 formed on the board 100 does not conduct to the pin 153*a* of the connector 152: in contrast, the other pads 102 conduct to the pins 153*b* to 153*d*, not shown, of the connector 152.

Here, compared to the action of a lever, the engagement portion between the first engaging portion 5 and the first locking portion 155 functions as a fulcrum during the attaching operation shown in FIGS. 6B to 6F whereas the front side of the ink tank 1 functions as a point on a lever (a portion indicated by the arrow P). A joint portion between the ink supply port 7 and an ink inlet port 107 functions as an acting point that is positioned between the point on the lever and the fulcrum, preferably, near the fulcrum. As a consequence, the ink supply port 7 can be pushed against the ink inlet port 107 by a large force according to the turn of the ink tank 1, to be thus joined to the ink inlet port 107. The joint portion between the ink supply port 7 and the ink inlet port 107 is normally made of an elastic member relatively excellent in flexibility such as a filter, an absorber, or a packing for the purpose of the secureness of ink flowability or the prevention of ink leakage.

In a case where the ink tank 1 is further depressed in the direction indicated by the arrow P, the ink tank 1 is turned in the turning direction $R_1$ in the state shown in FIGS. 6C, 6D. Specifically, the second engaging portion 6 intrudes into an opening formed at the second locking portion 156, and then, an engaging surface 8 of the second engaging portion 6 is moved under a locking surface 154 of the second locking portion 156 together with the displacement of the support member 3 in a direction indicated by an arrow $Q_2$, and thus, the second locking portion 156 does not press the side surface of the second engaging portion 6. Incidentally, the locking surface 154 is one surface defining the opening of the second locking portion 156. Here, the orientation of the engaging surface forms an angle with respect to the orientation of a movement trace of the second engaging portion 6. Therefore, in a case where the second engaging portion 6 is moved under the second locking portion 156, the ink tank 1 is excessively moved beyond a final attachment completion position once down to a position at which the ink tank 1 is most pushed in the direction indicated by the arrow P, that is, is overshot up to a position at a most distant end within a turnable range. In this state, the engaging surface 8 is not brought into contact with the locking surface 154. A position at which the engaging surface 8 is brought into contact with the locking surface 154 (FIGS. 6E, 6F) is the final attachment completion position. In contrast, the state shown in FIGS. 6C, 6D may be called a partly engaged state. The partly engaged state covers a state at a time when at least a part of the second engaging portion 6 intrudes into the opening formed at the second locking portion 156. The overshooting of the ink tank 1 will be described later in detail.

A distance between the pad 102 and the connector 152 is shortest in this state. The pads 102 and the pins 153*b* to 153*d*, not shown, are kept conducted to each other, and further, the pad 102 is conducted to pin 153*a*. The entire configuration including the pin 153*a*, the second engaging portion 6, and the second locking portion 156 is designed such that a timing at which the pad 102 is conducted to pin 153*a* comes after the second engaging portion 6 passes the final attachment completion position until the ink tank 1 is most pushed. A timing immediately after the second engaging portion 6 passes the final attachment completion position is much preferable.

In this state, force $F_1$ according to the pressing force acting from the ink supply port 7 to the ink inlet port 107 in the direction indicated by the arrow P balances with force $F_2$ acting from the ink inlet port 107 to the ink supply port 7 as a reaction against the force $F_1$. In a case where a user feels a contact to weaken the force $F_1$ even for a very short period of time, the ink tank 1 is urgingly turned in a reverse direction indicated by an arrow $R_2$ by the force $F_2$. Therefore, the engaging surface 8 of the second engaging portion 6 is brought into abutment against the locking surface 154 of the second locking portion 156, so that the second engaging portion 6 is locked to the second locking portion 156 at the final attachment completion position, thereby completing the attachment.

In this state, the pads 102 and the pins 153*b* to 153*d*, not shown, of the connector 152 are kept conducted to each other. As described above, the pad 102 and the pin 153*a* are designed in such a manner as to be changed from non-conduction to conduction after the second engaging portion 6 passes the final attachment completion position until the ink tank 1 is most pushed in the direction indicated by the arrow P. In other word, the conduction in the state shown in FIGS. 6C, 6D are changed to the non-conduction in the state shown in FIGS. 6E, 6F. The state becomes non-conductive again in the state shown in FIGS. 6E, 6F in which the ink tank 1 stays at the final attachment completion position.

The entire configuration including the pin 153*a*, the second engaging portion 6, and the second locking portion 156 is designed such that a timing at which the pad 102 and the pin 153*a* are conducted again from the non-conductive state is set sometime after the ink tank 1 is most pushed until the ink tank 1 stays at the final attachment completion position. The pad 102 and the pin 153*a* much preferably become conductive to each other again immediately before the ink tank 1 stays at the final attachment completion position. This is because this timing is substantially equal to a final timing at which the ink tank is mechanically attached to the holder, and therefore, substantial attachment completion can be detected, and then, a user is informed of the completion. Here, the above-described entire configuration is not contradictory to the entire configuration in which the timing of the conduction of the pin 153*a* is designed in the above-described manner.

The control unit 103 allows the light emitter 101 (FIG. 5A) attached to the board 100 to emit light upon the non-conduction of the pin 153*a*. At this time, the control unit 103 controls whether the light emission is kept or maintained for a predetermined period of time or longer after the pad 102 and the pin 153*a* are changed from the conduction to the non-conduction.

Figure 7:
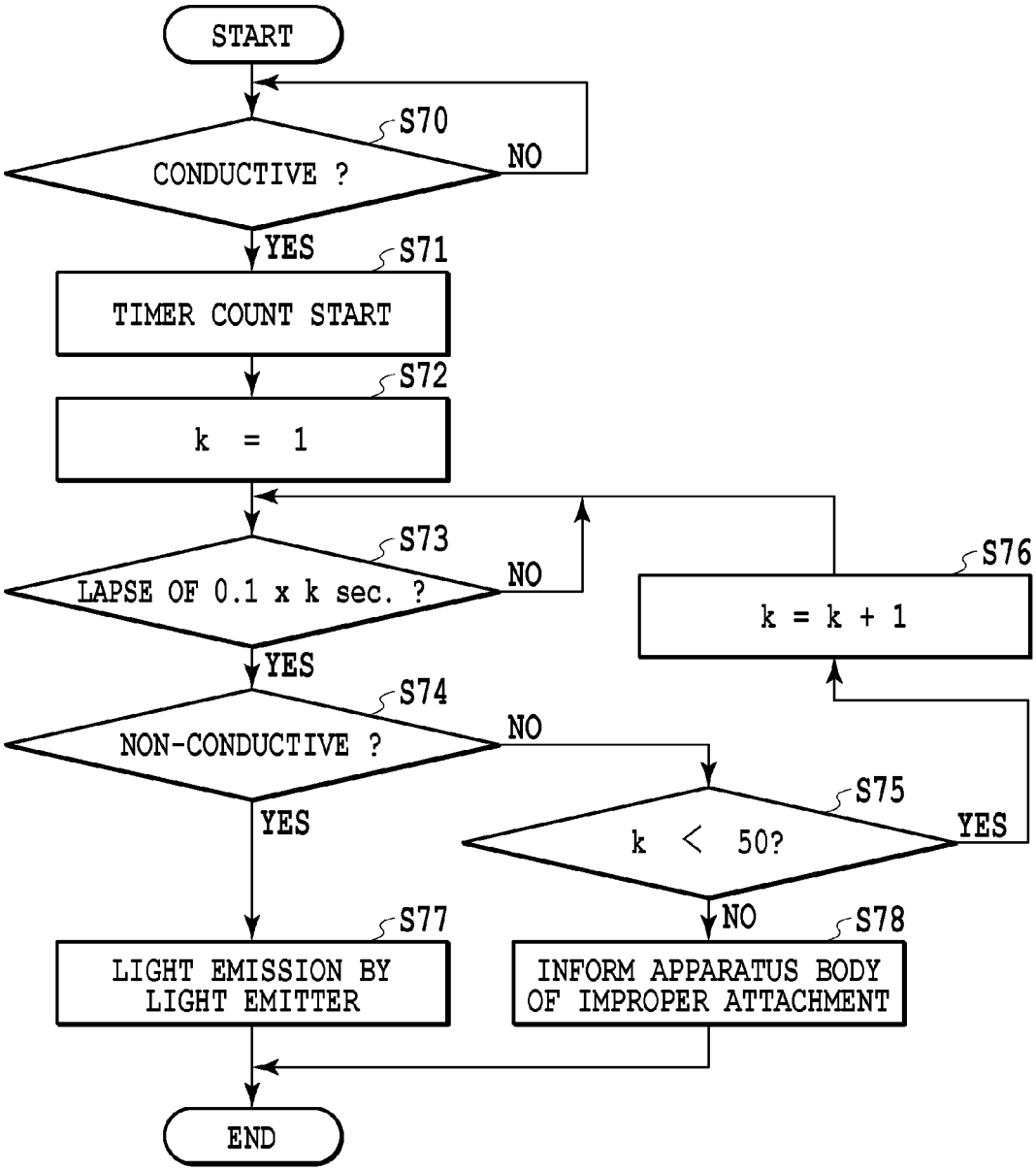
FIG. 7 is a flow chart illustrating a flow of control processing in the first embodiment of the present invention.

FIG. 7 is a flow chart illustrating a flow of control processing by the control unit 103.

In S70, it is checked whether or not the pad 102 and the pin 153*a* are conducted to each other. In a case where it is detected that the non-conductive state is changed to the conductive state, a timer starts counting for the purpose of following repeating processing (S71), and then, a variable K is set to an initial value (S72). Much preferably, the processing in S71 and S72 is performed immediately after the second engaging portion 6 passes the final attachment completion position (before the state shown in FIGS. 6C, 6D).

In the repeating processing in S73 to S76, the conductive state is checked every 0.1 second. In a case where the pad 102 and the pin 153*a* are not conducted again, the light emitter is controlled to emit light in S77. In a case where it is detected in the repeating processing in S73 to S76 that the conductive state continues for 5 seconds after the conduction is detected in S70, the processing proceeds to S78 through S74 and S75. In this case, the tank may not be properly attached for a reason of, for example, intrusion of foreign matter, and therefore, the apparatus body is informed of improper tank attachment from any of the pins 153*b* to 153*d* via the holder. A control circuit on the main body side that receives the information can perform control to display non-attachment on the display or the like, as required.

Figure 8:
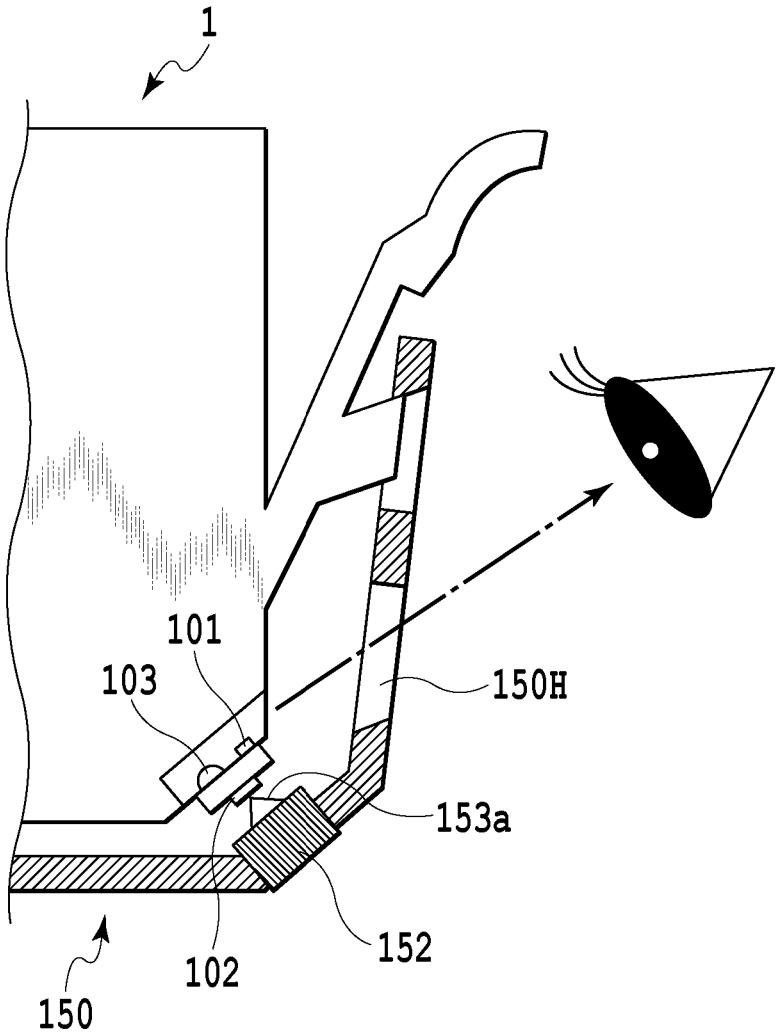
FIG. 8 is a cross-sectional view schematically illustrating a state in which a light emitter on the board provided for the ink tank emits light in the ink tank attaching procedures explained with reference to FIGS. 6A to 6F.

Referring to FIG. 8, explanation will be made on the light emission controlled in S77. FIG. 8 is a side view schematically illustrating the outline of a function of the board disposed at the ink tank.

Light emitted by the light emitter 101 reaches the visual field of a user through an opening 150H formed at the holder 150. In this manner, the information indicating that the ink tank 1 has been securely attached can be directly presented to the user. Specifically, a user visually sees the light emitted state of the light emitter 101 controlled by the control unit 103 so as to confirm that the ink tank 1 has been securely attached, as shown in FIG. 8. The control to indicate the securely attached state of the ink tank 1 is not limited to the simple light emission of the light emitter 101, but may be blinking or the like of the light emitter 101.

Figure 9:
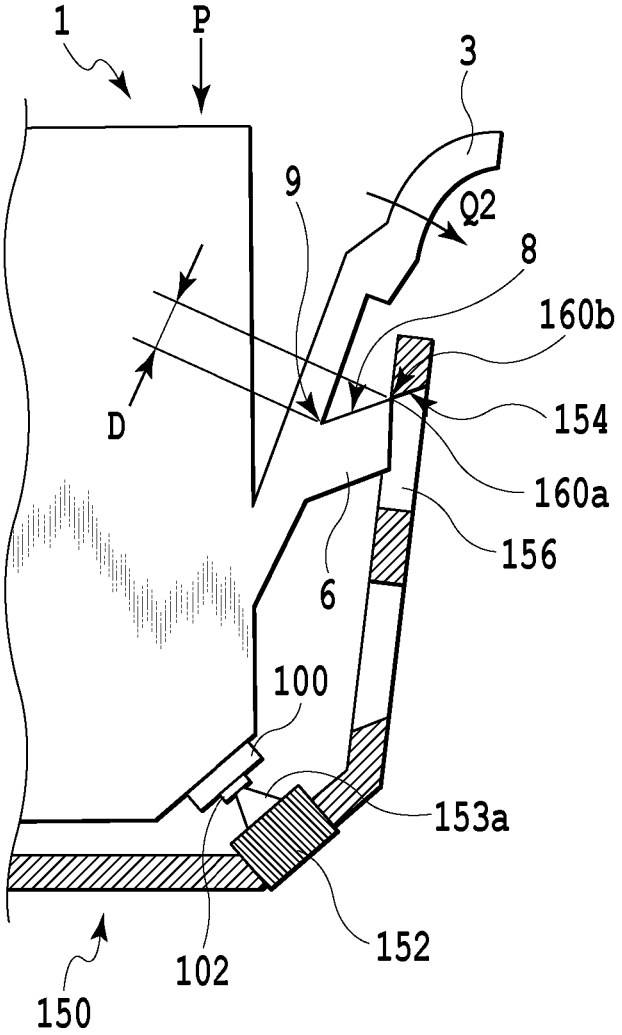
FIG. 9 is a cross-sectional view schematically illustrating operation in the ink tank attaching procedures illustrated in FIGS. 6A to 6F.

FIG. 9 is a schematic view showing the surroundings of the engaging portion for the sake of explanation on overshooting engagement in a case where the ink tank 1 is attached to the holder 150.

In the state shown in FIG. 6B, the side surface of the second engaging portion 6 of the ink tank 1 abuts against the second locking portion 156 whereas the engaging surface 8 is not yet brought into contact with the locking surface 154. In this state, in a case where the ink tank 1 is further depressed in the direction indicated by the arrow P, the ink tank 1 comes to a state shown in FIG. 9. Specifically, a corner 160*a* of the second engaging portion 6 matches a corner 160*b* of the second locking portion 156. At this time, since force for restoring the deformation of the support member 3 to the original state acts in the direction indicated by the arrow $Q_2$, the support member 3 is reversely deformed in the direction indicated by the arrow $Q_2$, and therefore, a part of the second engaging portion 6 intrudes into the opening formed at the second locking portion 156, so that the ink tank 1 comes to a state shown in FIGS. 6C, 6D. This state may be referred to as a partly engaged state.

The engaging surface 8 and the locking surface 154 form angles with respect to the direction indicated by the arrow $Q_2$ showing the movement trace of the support member 3, thus producing a clearance D. In a case where a user stops pushing the ink tank 1 in the direction indicated by the arrow P, the repulsion of the ink inlet port 107, as described above, displaces the ink tank 1 upward by the clearance D, so that the engaging surface 8 and the locking surface 154 come to the final engaged state. In this manner, in the present embodiment, the ink tank 1 is configured to be overshot once by the clearance D.

In the above-described present embodiment, the electrodes having the function of detecting the attachment of the ink tank to the holder are configured such that the conduction is changed to the non-conduction in the state in which the ink tank is substantially mechanically attached, and then, the light emitter provided for the ink tank emits the light according to the non-conduction. Consequently, even in a case where a user performs the attaching operation very slowly, a state substantially similar to the mechanic attachment of the ink tank is achieved upon recognition of the light emission. Thus, it is possible to prevent an early stop of the attaching operation by the user in an unsecure attached state. As a consequence, it is possible to further enhance the reliability of the liquid tank attachment.

Incidentally, the configuration for controlling the light emitter is not limited to the above-described one. The control circuit disposed on the main body side may detect the proper attachment of the ink tank according to the conduction of the electrode having the function of detecting the attachment of the ink tank to the holder when the ink tank is attached by the user, and then, control the light emitter disposed on the main body side. Furthermore, in place of or in addition to the control of the light emitter, the display disposed on the main body side may be controlled to display the detection result. Additionally, control may be performed in such a manner as to issue an alarm such as an electronic sound or generate vibrations at a vibrator.

Second Embodiment

In the first embodiment, a time difference between the conduction between the electrodes having the function of detecting the attachment of the ink tank to the holder and the conduction between the electrodes having the other functions is produced by a difference in length between the pins disposed at the connector. In the present embodiment, unlike the first embodiment, a time difference is produced according to configurations shown in FIGS. 10A to 10D.

Figure 10A:
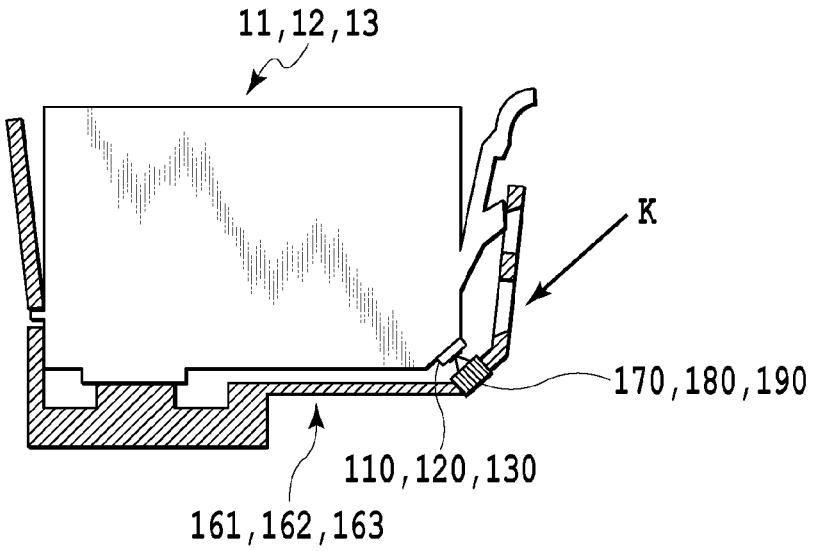
FIGS. 10A to 10D are cross-sectional views schematically showing the configuration of essential parts in a second embodiment of the present invention.

FIG. 10A is a schematic view showing a state in which an ink tank 11, 12, or 13 is attached to a holder 161, 162, or 163 of an ink jet print head, not shown. Here, a timing at which an engaging portion of the ink tank 11, 12, or 13 engages with a locking portion of the holder 161, 162, or 163 has been described in the first embodiment.

Figure 10B:
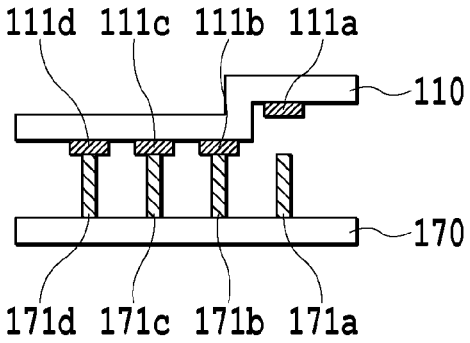
Figure 10C:
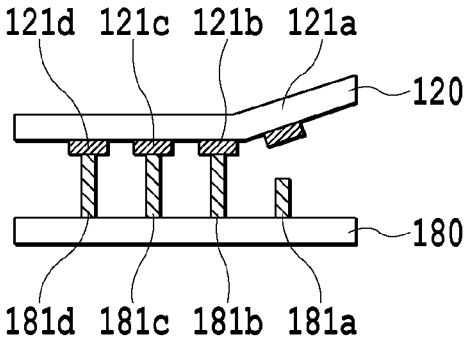
Figure 10D:
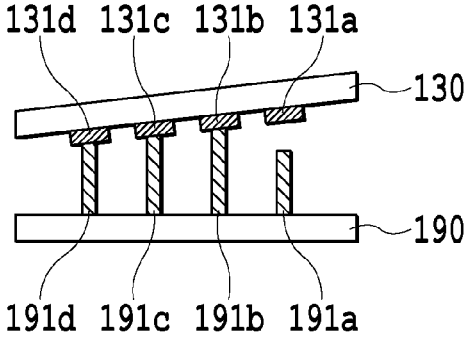

FIGS. 10B to 10D are schematic views showing boards 110, 120, and 130 and connectors 170, 180, and 190, respectively, as viewed in a direction indicated by an arrow K in FIG. 10A. Each of the boards 110, 120, and 130 includes a light emitter, not shown, for emitting visible light such as an LED and a control unit, not shown, for controlling the light emitter. The control unit controls the light emission by the light emitter according to the conductive state between the connector 170, 180, or 190 and a pad on the board 110, 120, or 130.

Particularly, FIG. 10B shows the board 110 and the connector 170 in the same attaching procedure as that in the state shown in FIGS. 6E, 6F in the first embodiment. Pads 111*a* to 111*d* are mounted on the board 110. The pad 111*a* has the function of transmitting that the ink tank 11 is attached to the holder 161: in contrast, the pads 111*b* to 111*d* have the function of transmitting various pieces of information on the residual amount of ink in the ink tank 11 and the like. The board 110 is bent in a crank manner. The pad 111*a* is placed at a portion on the board 110 farthest from the connector 170.

To the connector 170 is fixed a pin 171*a* corresponding to the pad put on the board 110 provided for the ink tank 11. The pin 171*a* has the function of transmitting the attachment of the ink tank 11 to the holder 161. Pins 171*b* to 171*d* have the function of transmitting various pieces of information on the residual amount of the ink in the ink tank 11 and the like. All of the pins 171*a* to 171*d* have the same length. Consequently, the cranked shape of the board 110 enables the pad 111*b* to 111*d* to be conducted to the pins 171*b* to 171*d*, respectively, whereas it prevents the pad 111*a* and the pin 171*a* from being conducted to each other.

Next, FIG. 10C shows the board 120 and the connector 180 during the same attaching procedure as that in the state shown in FIGS. 6E, 6F in the first embodiment. Pads 121*a* to 121*d* are mounted on the board 120. The pad 121*a* has the function of transmitting that the ink tank 12 is attached to the holder 162: in contrast, the pads 121*b* to 121*d* have the function of transmitting various pieces of information on the residual amount of ink in the ink tank 12 and the like. The board 120 is bent in a V shape. The pad 121*a* is placed at a portion on the board 120 farthest from the connector 180.

To the connector 180 is fixed a pin 181*a* corresponding to the pad put on the board 120 provided in the ink tank 12. The pin 181*a* has the function of transmitting the attachment of the ink tank 12 to the holder 162. Pins 181*b* to 181*d* have the function of transmitting various pieces of information on the residual amount of the ink in the ink tank 12. All of the pins 181*b* to 181*d* have the same length: in contrast, the pin 181*a* is shorter than the pins 181*b* to 181*d*. Consequently, the V-bent shape of the board 120 and the short pin 181*a* enable the pads 121*b* to 121*d* to be conducted to the pins 181*b* to 181*d*, respectively whereas they prevent the pad 121*a* and the pin 181*a* from being conducted to each other.

Subsequently, FIG. 10D shows the board 130 and the connector 190 during the same attaching procedure as that in the state shown in FIGS. 6E, 6F in the first embodiment. Pads 131*a* to 131*d* are mounted on the board 130. The pad 131*a* has the function of transmitting that the ink tank 13 is attached to the holder 163: in contrast, the pads 131*b* to 131*d* have the function of transmitting various pieces of information on the residual amount of ink in the ink tank 13 and the like. The board 130 is not parallel to the connector 190, that is, is disposed with a predetermined inclination. The pad 131*a* is placed at a portion on the board 130 remotest from the connector 190.

To the connector 190 is fixed a pin 191*a* corresponding to the pad put on the board 130 provided for the ink tank 13. The pin 191*a* has the function of transmitting that the ink tank 13 is attached to the holder 163. Pins 191*b* to 191*d* have the function of transmitting various pieces of information on the residual amount of the ink in the ink tank 13 and the like. The pins 191*a* to 191*d* have different lengths according to the above-described inclination of the board 130 in such a manner as to achieve the same conduction timing. The pin 191*a* is shorter than the pins 191*b* to 191*d* in such a manner as to achieve conduction at a timing later than the pins 191*b* to 191*d*. Consequently, the inclination of the board 130 and the short pin 191*a* enable the pads 131*b* to 131*d* to be conducted to the pins 191*b* to 191*d*, respectively, whereas they prevent the pad 131*a* and the pin 191*a* from being conducted to each other.

With the above-described configurations shown in FIGS. 10B to 10D, like the first embodiment, the electrodes having the function of transmitting that the ink tank is attached to the holder can be conducted after the ink tank is mechanically attached in a secure manner. Consequently, it is possible to inform a user of the secure state with the help of the light emission by the light emitter according to the conduction so as to prevent a user from early stopping the attaching operation in an uncertain attached state.

[Other Modifications]

Although the ink tank is configured to be attached to the ink jet print head fixed to the carriage that reciprocates in the ink jet printing apparatus in the above-described embodiments, the present invention is not limited to this. For example, the present invention is applicable to a configuration in which an ink tank is attached to a holder that does not reciprocate in an ink jet printing apparatus, and then, ink is supplied to the ink jet print head via a tube or the like.

Moreover, the ink jet print head shown in FIG. 2 is of a type in which the heat generation resistance element is contained in the liquid channel constituting the nozzle, and then, it receives the pulse signal to eject the ink. However, the present invention is not limited to this. For example, the present invention is applicable to a type in which a piezoelectric element for transducing voltage to force is used.

Although the description has been given of the configuration in which the ink tank and the ink jet print head are independent of each other in the above-described embodiments, an ink tank may additionally have the function of an ink jet print head.

Additionally, although the user is informed of the attachment of the ink tank from the ink tank directly or via the ink jet printing apparatus body in the above-described embodiments, the ink jet printing apparatus and/or a host apparatus of the ink jet printing apparatus may be informed, as required.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-171700, filed Aug. 26, 2014, which is hereby incorporated by reference wherein in its entirety.

What is claimed is:

1. A liquid tank installable in a liquid ejecting apparatus, the liquid tank comprising:

a structure to be attached to an attaching unit of the liquid ejecting apparatus, wherein the attaching unit includes an introducing portion, a locking portion and a first apparatus-side electrode, and wherein the structure includes a supplying portion for joining to the introducing portion and an engaging portion engageable with the locking portion, wherein the supplying portion is joined to the introducing portion at an attachment completion position at which the engaging portion engages with the locking portion, so as to supply a contained liquid from the supplying portion to the liquid ejecting apparatus via the introducing portion;

a first tank-side electrode corresponding to the first apparatus-side electrode;

an informing unit; and a control unit configured to control the informing unit according to a conduction state between the first apparatus-side electrode and the first tank-side electrode, wherein the liquid tank is moved with respect to the attaching unit by force acting at a predetermined portion in a predetermined direction so that the engaging portion engages with the locking portion, and thus, the liquid tank is attached to the attaching unit at the attachment completion position, and the liquid tank is configured such that a conduction state between the first apparatus-side electrode and the first tank-side electrode is changed from the conductive state to a non-conductive state before the liquid tank is fixed at the attachment completion position in engagement of the engaging portion with the locking portion during movement reverse to the predetermined direction after the liquid tank passes beyond the attachment completion position during the movement in the predetermined direction.

2. The liquid tank according to claim 1, wherein the engaging portion includes a projection whereas the locking portion includes an opening, the projection intrudes into the opening during the movement in the predetermined direction, and further, a surface forming the projection abuts against one surface defining the opening during the movement in the direction reverse to the predetermined direction, so that the engaging portion engages with the locking portion so as to fix the liquid tank at the attachment completion position.

3. The liquid tank according to claim 2, wherein the liquid tank includes a rod-like member, and the projection is provided on the rod-like member, and the rod-like member is deformed in such a manner as to approach a main body of the liquid tank based on the force acting on the predetermined portion in a case where the projection abuts against a portion near the opening in the attaching unit during the movement in the predetermined direction.

4. The liquid tank according to claim 2, wherein orientations of the surface forming the projection and the surface defining the opening are different from an orientation of a trace on which the rod-like member is moved according to the movement of the liquid tank in the predetermined direction.

5. The liquid tank according to claim 1, wherein the attaching unit includes plural apparatus-side electrodes including the first apparatus-side electrode and at least one second apparatus-side electrode, the liquid tank includes plural tank-side electrodes including the first tank-side electrode and at least one second tank-side electrode, the plural tank-side electrodes corresponding to the plural apparatus-side electrodes, and the second apparatus-side electrode and the second tank-side electrode are configured to be conducted to each other in a case where the liquid tank reaches the attachment completion position during the movement in the predetermined direction, and further, the second apparatus-side electrode and the second tank-side electrode are configured to be conducted to each other after the liquid tank reaches the attachment completion position and before it reaches a remotest end within a movable range, and the control unit includes a unit for detecting that the first apparatus-side electrode and the first tank-side electrode are kept conducted to each other for a predetermined period of time after the first apparatus-side electrode and the first tank-side electrode are conducted to each other, and further, the liquid ejecting apparatus is informed of information representing that the liquid tank cannot be attached to the attaching unit according to the continuation of the detected conduction via the second apparatus-side electrode and the second tank-side electrode which are conducted to each other.

6. The liquid tank according to claim 1, wherein the attaching unit includes plural apparatus-side electrodes including the first apparatus-side electrode and at least one second apparatus-side electrode, the liquid tank includes plural tank-side electrodes including the first tank-side electrode and at least one second tank-side electrode, the plural tank-side electrodes corresponding to the plural apparatus-side electrodes, and the second apparatus-side electrode and the second tank-side electrode are configured to be conducted to each other in addition to the non-conduction between the first apparatus-side electrode and the first tank-side electrode in a case where the liquid tank is fixed at the attachment completion position, and further, information about the liquid tank is transmitted or received between the liquid tank and the liquid ejecting apparatus via the second apparatus-side electrode and the second tank-side electrode which are conducted to each other.

7. The liquid tank according to claim 1, wherein an elastic member is provided at a portion at which the supplying portion and the introducing portion are joined to each other, and the elasticity of the elastic member allows the liquid tank to be moved in a direction reverse to the predetermined direction.

8. The liquid tank according to claim 1, wherein the informing unit includes a light emitting element.

9. A liquid ejecting apparatus comprising:

an attaching unit for attaching a liquid tank, the attaching unit including an introducing portion, a locking portion and a first apparatus-side electrode; and an ejecting portion for ejecting liquid supplied from the liquid tank through the introducing portion, wherein the liquid tank comprises:

a structure to be attached to the attaching unit of the liquid ejecting apparatus, wherein the structure includes a supplying portion for joining to the introducing portion and an engaging portion engageable with the locking portion, wherein the supplying portion is joined to the introducing portion at an attachment completion position at which the engaging portion engages with the locking portion, so as to supply a contained liquid from the supplying portion to the liquid ejecting apparatus;

a first tank-side electrode corresponding to the first apparatus-side electrode;

an informing unit; and a control unit configured to control the informing unit according to a conduction state between the first apparatus-side electrode and the first tank-side electrode, wherein the liquid tank is moved with respect to the attaching unit by force acting at a predetermined portion in a predetermined direction so that the engaging portion engages with the locking portion, and thus, the liquid tank is attached to the attaching unit at the attachment completion position, and the liquid tank is configured such that a conduction state between the first apparatus-side electrode and the first tank-side electrode is changed from the conductive state to a non-conductive state before the liquid tank is fixed at the attachment completion position in engagement of the engaging portion with the locking portion during movement reverse to the predetermined direction after the liquid tank passes beyond the attachment completion position during the movement in the predetermined direction.

10. The liquid ejecting apparatus according to claim 9, wherein the liquid is ink, and further, the ejecting portion is an ink jet print head.

11. The liquid tank according to claim 5, wherein in the movement, before reaching the attachment completion position, each of the plural tank-side electrodes faces a corresponding one of the plural apparatus-side electrodes at separation distance, and the separation distance of the first tank-side electrode relative to the first apparatus-side electrode is more remote than the separation distance of the second tank-side electrode relative to the second apparatus-side electrode.

* * * * *